US005727254A

United States Patent [19]

Dicker

[11] Patent Number: 5,727,254

[45] **Date of Patent: *Mar. 17, 1998**

[54] RESISTIVE EXERCISE PANTS AND HAND STIRRUPS

[76] Inventor: Timothy P. Dicker, 11359 Dornfield, Lake View Terrace, Calif. 91342

[ * ] Notice: The term of this patent shall not extend beyond the expiration date of Pat. No. 5,570,472.

[21] Appl. No.: 660,098

[22] Filed: Jun. 6, 1996

Related U.S. Application Data

[63] Continuation-in-part of Ser. No. 554,733, Nov. 7, 1995, Pat. No. 5,570,472.

[51] Int. Cl.[6] ..... A41B 1/12

[52] U.S. Cl. ..... 2/69; 2/115; 2/227; 2/79; 482/105

[58] Field of Search ..... 2/69, 79, 227, 2/228, 238, 115, 159, 160; 450/104; 482/105

[56] References Cited

U.S. PATENT DOCUMENTS

| | | |
|---|---|---|
| 1,178,165 | 8/1916 | Lupton . |
| 4,698,847 | 10/1987 | Yoshihara . |
| 4,910,802 | 3/1990 | Malloy . |
| 4,953,856 | 9/1990 | Fox, III . |
| 4,961,573 | 10/1990 | Wehrell . |
| 4,968,028 | 11/1990 | Wehrell . |
| 4,993,705 | 2/1991 | Tölle . |
| 5,033,123 | 7/1991 | Audet . |
| 5,046,194 | 9/1991 | Alaniz et al. . |
| 5,060,315 | 10/1991 | Ewing . |
| 5,062,642 | 11/1991 | Berry et al. . |
| 5,109,546 | 5/1992 | Dicker . |
| 5,141,223 | 8/1992 | Block . |
| 5,176,600 | 1/1993 | Wilkinson . |
| 5,186,701 | 2/1993 | Wilkinson . |
| 5,201,074 | 4/1993 | Dicker . |
| 5,203,754 | 4/1993 | Maclean . |
| 5,256,119 | 10/1993 | Tudor . |
| 5,263,916 | 11/1993 | Bobich . |
| 5,267,928 | 12/1993 | Barile et al. . |
| 5,282,277 | 2/1994 | Onozawa . |
| 5,306,222 | 4/1994 | Wilkinson . |
| 5,308,305 | 5/1994 | Romney . |
| 5,336,139 | 8/1994 | Miller . |
| 5,357,637 | 10/1994 | Moore . |
| 5,367,708 | 11/1994 | Fujimoto . |
| 5,372,565 | 12/1994 | Burdenko . |
| 5,375,610 | 12/1994 | Lacourse . |
| 5,383,235 | 1/1995 | Peters . |
| 5,465,428 | 11/1995 | Earl . |
| 5,518,480 | 5/1996 | Frappier . |
| 5,518,481 | 5/1996 | Darkwah . |
| 5,570,472 | 11/1996 | Dicker . |

*Primary Examiner*—Gloria Hale
*Attorney, Agent, or Firm*—Connelly & Hutz

[57] ABSTRACT

Resistive exercise pants optimize resistance and enhance breathability by limiting the number of resistive bands in aligned coordination with the muscles of the leg. Additionally, hand stirrups are set forth that provide better attachment of resistive exercise sleeves to the extremities. In the resistive exercise pants, a single, wide band or two spaced-apart resistive bands generally traverse the length of the leg from the hips to a heel stirrup. Suspenders provide attachment of the resistive exercise pants to the shoulders, thereby holding the length of the body in dynamic tension. In the preferred embodiment, pairs of resistive bands run the length of each pant leg along the front and back in alignment with the leg's long muscles. The front pair of resistive bands bifurcate adjacent the knee to conformedly curve about the calf and to form a heel stirrup with the rear pair of resistive bands. For the single resistive band embodiment, bifurcation occurs adjacent the knee and generally progresses in a linear fashion down to the ankle where a heel stirrup is formed. The hand stirrups generally engage the fingers to provide an alternative to a thumb stirrup, thereby distributing tension applied by resistive bands running along the sleeve of an exercise-resistive shirt. In alternative embodiments, the entire hand is circumscribed by an elastic circular band or the like with greater securement of the hand stirrup achieved by elastic finger bands passing through finger interstices.

38 Claims, 4 Drawing Sheets

RESISTIVE EXERCISE PANTS AND HAND STIRRUPS

CROSS-REFERENCES TO RELATED APPLICATIONS

This application is a continuation-in-part application of U.S. patent application Ser. No. 08/554,733, filed Nov. 7, 1995, now U.S. Pat. No. 5,570,472.

BACKGROUND OF THE INVENTION

1. Field of the Invention

This invention relates to exercise garments that provide resistance to muscular activity to enhance exercise and, more particularly, to resistive exercise pants and resistive exercise hand straps for use in conjunction with a resistive exercise shirt.

2. Description of the Related Art

The related art has not been substantially enhanced since the filing of preceding U.S. application Ser. No. 08/554,733, filed Nov. 7, 1995, which is incorporated herein by this reference thereto.

Substantially, aerobic exercise is not necessarily the type of exercise needed to develop muscles such as those present in the arms, legs, and abdomen. While aerobic exercise is excellent for circulation and stimulating the heart muscle, aerobic activity does not necessarily give a good workout to the long muscles of the arms and legs or to the abdomen.

Generally, it is inconvenient to attach bulky weights to the body while performing aerobic activities. Such weights tend to get in the way during aerobic exercise, and any quick movements by the exerciser may create forces that are so substantial as to injure the exerciser wearing the weights.

It has been found that providing an exercise suit having resistive members provides a lightweight and non-injurious alternative to wearing weights while engaging in aerobic activity. The preceding application substantially sets forth a resistive suit having resistive members that provide adjustable muscular exercise during aerobic activity by resisting the movements of the exerciser wearing the resistive suit. Certain advancements have been made whereby the resistive suit of the prior application is enhanced and made more advantageous by the improved resistive pants and hand stirrups disclosed herein.

SUMMARY OF THE INVENTION

The present invention provides enhanced muscular activity during aerobic exercise by providing a set of exercise-resistive pants having single or double bands of resistive, or resistant, material. These embodiments of the resistive exercise pants are an improvement upon the plurality of resistive bands set forth in the prior application. Furthermore, useful and advantageous hand stirrups for use in conjunction with an exercise-resistive shirt, as disclosed in the prior application, are set forth.

The resistive exercise pants are constructed to fit closely to the anatomy of the exerciser. Incorporated within the resistive exercise pants are one or two pairs of resistive exercise bands per pant leg.

For the single pair of resistive bands per pant leg, the resistive bands run lengthwise down the length of the pant leg from the top of the resistive pants to the stirrup bottoms. One band of the resistive pair is located along the front of the wearer's leg while the other band runs down the back of the leg. The other pair of resistive bands on the other pant leg are similarly disposed. At approximately the knee or below, the single pair of resistive bands each split in a forked manner to engage the heel of the wearer by means of a stirrup or the like. Adjustable suspenders serve to provide resistance between the heels and shoulders of the wearer of the resistive exercise pants.

In a second and generally preferred embodiment, two pairs of resistive bands oppositely opposed on front and rear portions of each pant leg are present and engage the heel in a stirrup-like manner. The front resistive bands tend to curve about calf in order to engage the ankle and heel while the rear pair of resistive bands are similarly disposed to engage the ankle and heel. Adjustable suspenders also serve to provide resistive exercise for the muscles located between the wearer's heels and shoulders.

Hand stirrups (for use with the resistive exercise shirt having a pair of resistive bands on opposite sides of each sleeve) have straps with finger slots to engage the interstices between the fingers. Two finger slots are defined by the strap which is connected to an upper resistance, or resistive, band to engage the arm resistance band on the opposite side of the arm. In order to provide ease of use and convenient attachment and detachment, coupling between the hand strap and the opposite resistance band may be adjacent the palm of the wearer's hand.

Alternatively, a hand stirrup may be provided that has an elastic circular band that surrounds or is adjacent to the knuckles of the four fingers with elastic finger bands serving to secure the circular knuckle band to the wearer's hand. The elastic circular knuckle band is attached to both resistive sleeve bands. The securement provided by the finger straps is enhanced by the support given by the thumb. The finger straps fit into the interstices of the individual fingers.

In a third embodiment of the hand stirrups, two upper main tension bands running along or extending from the sleeve band of the arm of the resistive exercise shirt may fit into the interstices of fingers as finger bands. The hand stirrup includes a loop of material that encircles the hand. The loop is formed by a continuation, or extension, of the tension band running along the underside of the sleeve. This tension band is oppositely opposed to the tension band that runs along the top, or upper, side of the sleeve. A slip loop or the like at the end of the tension-band extension encircles a nearby portion of the tension band to form the encircling loop. The encircling loop may wrap around the hand adjacent the four finger knuckles and above the thumb to form the hand stirrup. The finger bands or the like may engage the encircling loop to secure the hand stirrup to the hand.

In a similar manner, the slip loop of the underside tension band may have a flap allowing tightening of the loop of material forming the hand stirrup. Along with finger bands fitting into the finger interstices, the stirrup may be tightened around the hand in an adjustable manner to provide varying levels of resistance from the resistive exercise shirt.

OBJECTS OF THE INVENTION

It is an object of the present invention to provide resistive exercise pants having fewer resistive exercise bands to provide enhanced muscular development during aerobic activity.

It is another object of the present invention to provide a pair of resistive exercise pants having a single pair of resistive bands on each pant leg, the pair of resistive bands being oppositely opposed toward the front and back of the leg.

It is another object of the present invention to provide a pair of resistive exercise pants having two pairs of resistive bands per pant leg with two resistive bands running along the front of the leg and two resistive bands running along the rear of the leg.

It is yet another object of the present invention to provide a pair of resistive exercise pants having two pairs of resistive bands per pant leg with the resistive bands wrapping around the calf and ankle of the wearer.

It is yet another object of the present invention to provide advantageous hand stirrups to securely engage resistive bands of resistive sleeves in a resistive exercise shirt.

These and other objects and advantages of the present invention will be apparent from a review of the following specification and accompanying drawings.

DESCRIPTION OF THE PREFERRED EMBODIMENTS

The present invention resides in an enhanced design for resistive exercise pants. Hand stirrups for use in conjunction with a resistive exercise shirt are also disclosed. Generally, the resistive exercise pants incorporate an enhanced design with respect to resistive bands that force the leg muscles to work more strenuously during aerobic or similar exercise. The hand stirrups disclosed in the present invention are able to replace previously known thumb stirrups and provide enhanced exercise when used in conjunction with the resistive exercise shirt as disclosed in the prior patent application.

The resistive exercise pants of the present invention are shown in FIGS. 1–4. The present design of the resistive exercise pants incorporates fewer resistive bands traversing the length of each individual pant leg, which, while lowering the overall resistance of the pants, serves to enhance their effectiveness by as much as 25 percent or more.

Figure 1:
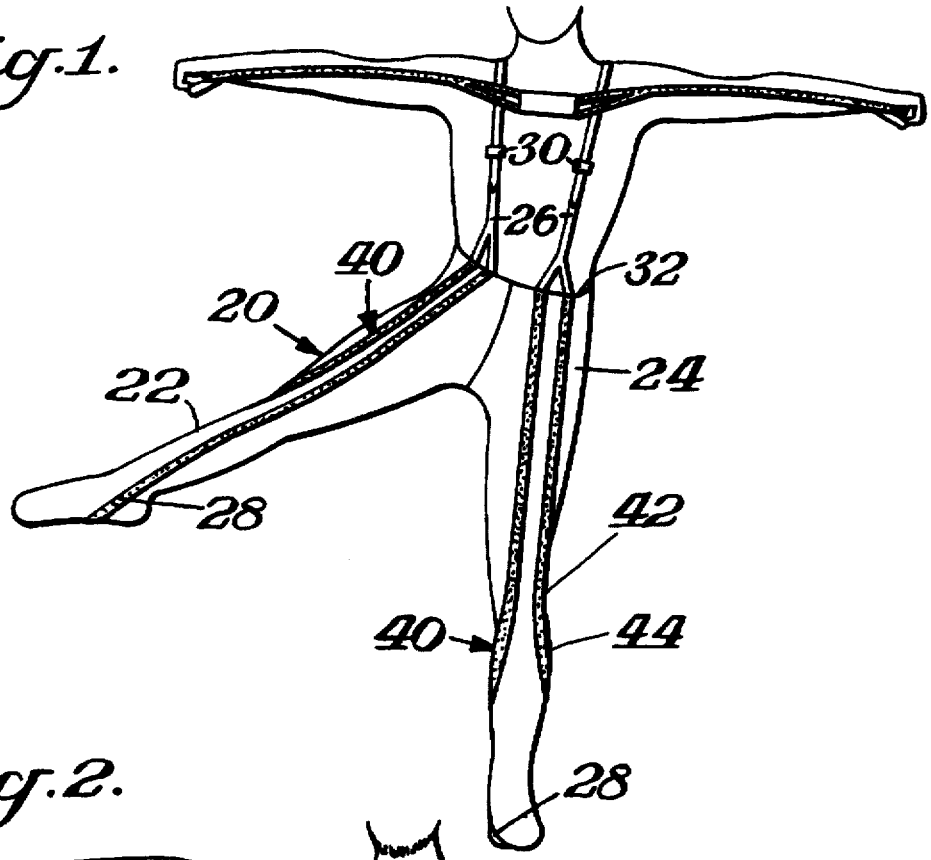
FIG. 1 is an anterior elevational view of the preferred resistive exercise pants of the present invention shown with a wearer of such pants.

As shown in FIG. 1, the resistive exercise pants 20 have two individual right and left pant legs 22, 24, respectively. The resistive exercise pants 20 are held in dynamic tension across the height of the wearer's body between suspenders 26 and heel stirrups 28. The suspenders 26 are adjustable as by a buckle or the like 30 so that the amount of tension applied may be varied and so that the fit of the pants 20 to the wearer may be adjusted.

The resistive exercise pants 20 of the present invention generally resemble ordinary pants, or trousers, and fit closely to the form of the wearer. The pants 20 are constructed of breathable and resilient materials so that the pants 20 are not unpleasant to wear during vigorous exercise. Contemplated fabrics for use in constructing the pants 20 of the present invention should stretch in order to allow the wearer great freedom of movement and include such materials as cotton or any other flexible and breathable material such as those marketed under the trade names LYCRA®, SPANDEX®, or the like. Combinations of such materials may also be used. A waistband 32 encircles the wearer's hips or waist and may be elastic to provide a close fit.

Figure 2:
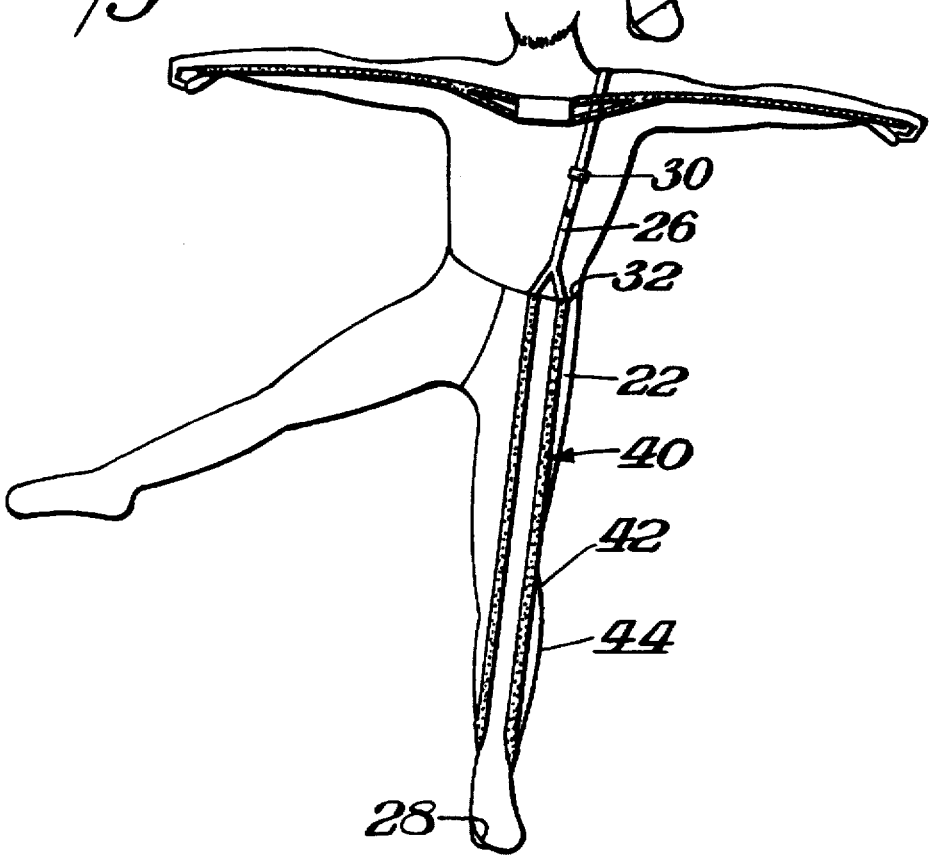
FIG. 2 is a posterior elevational view of the preferred resistive exercise pants of the present invention of FIG. 1 shown with the wearer of such pants.

As shown in FIGS. 1 and 2, traversing the length of each pant leg at both the front and the rear are a pair of resistive bands 40. Each of the bands is made of resilient and elastic material that resists muscle flexion in order to better exercise the leg muscles. Various forms of dense and flexible plastics may be used in the resistive bands 40. However, the specific material used in the resistive bands 40 is not so important as is the flexible response to the pulling stress imposed upon them during aerobic or other exercise.

In the preferred embodiment, the two pairs of front resistive bands (FIG. 1) descend from the waistband 32 adjacent the suspenders 26 linearly until bifurcating adjacent the knee 42. Upon reaching the knee 42, each front pair of resistive bands 40 diverge from their parallel travel to generally conform to the curvature of the calf 44. The partially helical path of travel to conform to the curvature of the calf 44 is performed by the resistive bands upon their diverging below the knee. Each band then descends along the lower portion of the leg to intersect and connect with the corresponding resistive bands present at the back of the resistive exercise pants 20 to form the heel stirrup 28.

The structure of the pairs of resistive bands 40 is similar for each pant leg 22, 24. By using pairs of resistive bands 40, as shown in FIGS. 1 and 2, more efficient use of the resistive material is used as the resistive bands 40 generally coincide with the structure of the underlying leg muscles. As muscles are only able to extend or flex, aligning the resistive bands to generally coincide with the long muscles of the legs serves to focus the resistive portions of the resistive pant legs 20 to work against those muscles of most interest to aerobic exercisers and the like.

By reducing the amount of resistive material used in the resistive exercise pants 20, the pants are made more breathable and allow the exercising wearer to more freely engage in aerobic exercise or the like without suffering a loss from the degree of muscular exercise offered by present resistive exercise pants. By spacing the resistive bands approximately three to seven inches apart, focus is made upon the long muscles of the legs; and the resistive force of the bands is distributed over a wider area.

As shown in FIG. 2, the resistive bands 40 at the rear of the resistive exercise pants 20 generally run from the waistband 32 adjacent the suspenders 26 to the heel stirrups 28 in a generally linear manner without significant curvature or bifurcation.

Figure 3:
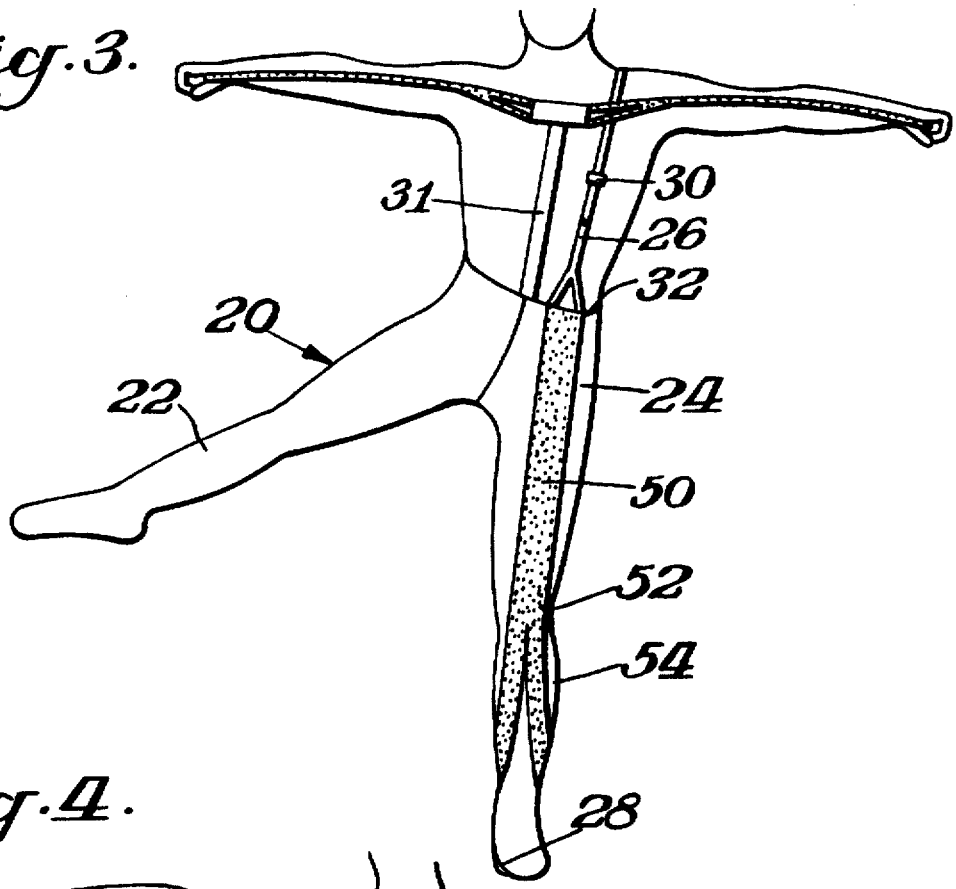
FIG. 3 is an anterior elevational view of an alternative embodiment of the resistive exercise pants of the present invention shown with the wearer of such pants.
Figure 4:
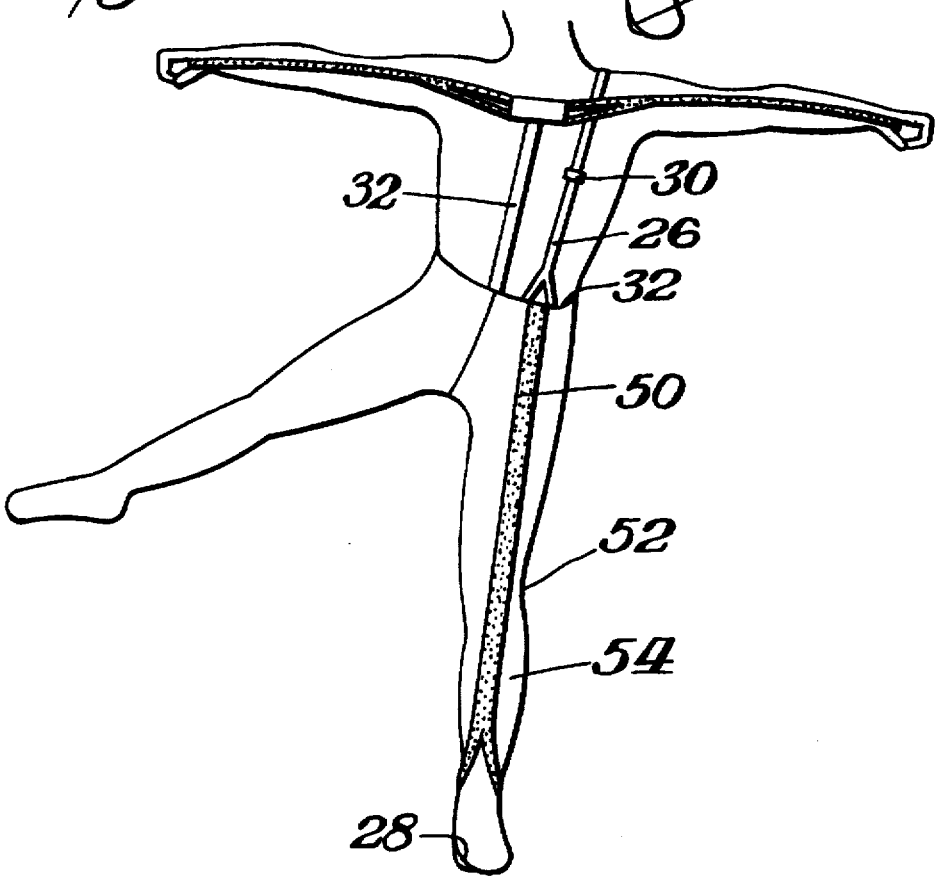
FIG. 4 is a posterior elevational view of the resistive exercise pants shown in FIG. 3 shown with the wearer of such pants.

An alternative embodiment of the present invention is shown in FIGS. 3 and 4 where the pairs of resistive bands have been replaced by a single integral band 50. The band traversing the front length of the resistive exercise pants 20 bifurcates adjacent the knee 52 but does not conform to the curvature of the calf. Instead, the bifurcating band portion 54 travels along the lower portion of the leg along the shin. The bifurcated portion 54 travels along the lower leg to intersect and connect with the corresponding portion of the rear band 50 at the end of its bifurcated portion 54 to form the heel stirrup 28. As for the embodiment shown in FIGS. 1 and 2, the right 22 and left 24 pant legs are constructed similarly, each having integral resistive bands 50 at the front and rear of each pant leg.

As for the preferred embodiment with its pairs of resistive bands 40, the alternative embodiment using single resistive bands 50 optimizes the use of resistive band material to make the resistive exercise pants 20 more breathable and easier to wear due to the focusing, or concentration, of the resistive material along the long muscles generally responsible for leg articulation and exercise.

As shown in FIGS. 3 and 4, the width of the single integral resistive band 50 is generally wider than the individual bands and the pair of resistive band 40 of FIGS. 1 and 2. Such width may be varied according to the tension desired in the resistive exercise pants 20 with wider bands 50 delivering more tension and more resistance than narrower bands. FIGS. 3–4 also illustrate an abdominal resistive panel 31 on the anterior of the shirt portion of the garment (FIG. 3) and a rector spinal resistive panel 33 on the posterior of the shirt portion (FIG. 4).

For both of the two embodiments shown in FIGS. 1–4, a person seeking greater muscular activity during aerobic exercise or the like may don the resistive exercise pants 20 much in the same way as tights or the like. The stirrups 28 are adjusted to address the heel of the wearer, while the waistband 32 is comfortably set into place upon smoothing out the resistive exercise pants 20 along the length of both legs. The suspenders 26 are then looped over the wearer's shoulders and adjusted for comfort and tension. The wearer is now ready to engage in aerobic or similar activities while wearing the resistive exercise pants 20, the wearer not only stimulating cardiac response and general circulation but also developing the muscles along the length of the legs.

As stated in the prior application and incorporated by this reference thereto, a resistive exercise shirt generally has central blocks of resistive materials connected to the extremities by means of resistive bands running along both sides of the arms. It has been found that the use of hand stirrups instead of thumb stirrups provides significant advantages in maintaining the resistive tension distributed by the resistive arm bands along the length of the arm. FIGS. 5–12 show four different embodiments of the hand stirrup of the present invention.

Figure 5:
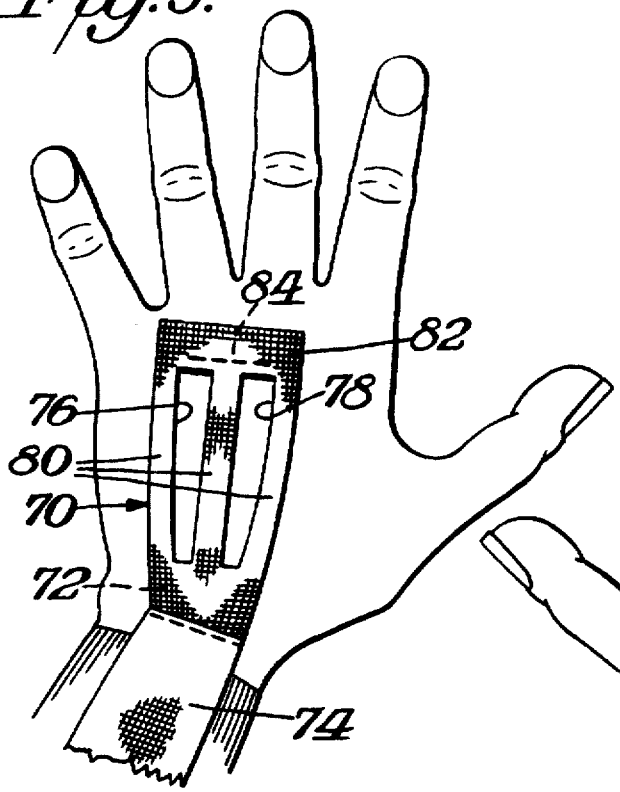
FIG. 5 is a dorsal plan view of the preferred hand stirrups of the present invention shown with a wearer's hand.
Figure 6:
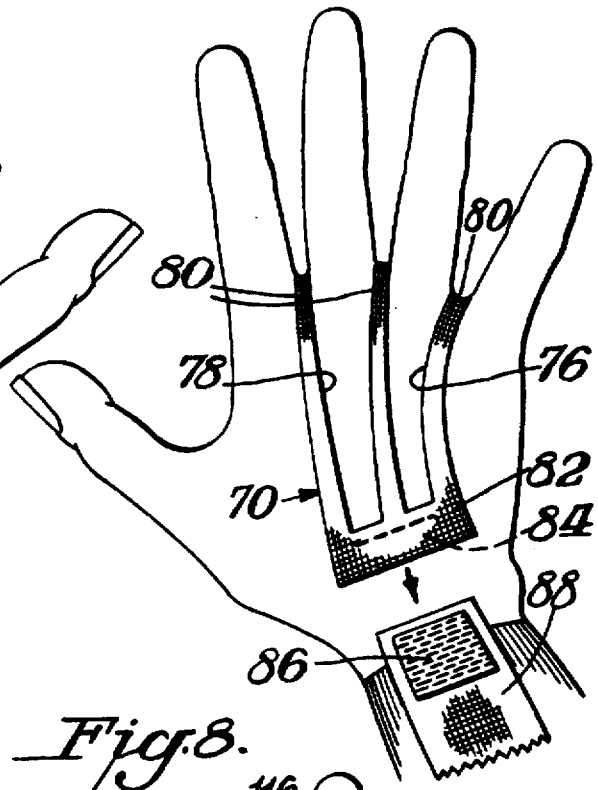
FIG. 6 is a palmar plan view of the hand stirrup shown in FIG. 5 shown with the wearer's hand.

Referring now to FIGS. 5 and 6, dorsal and palmar views of a preferred embodiment of the hand stirrup of the present invention are shown. In FIG. 5, the hand stirrup 70 is attached at one end 72 to a main resistance band 74 that generally runs the length of the wearer's arm. The hand stirrup 70 has a pair of finger slots 76, 78 that are defined between three elastic straps 80 that intermediate the attached end 72 of stirrup 70 and the free removably attachable end 82 of the hand stirrup 70. Underneath the free removably attachable end 82 of stirrup 70 is one half of a hook-and-loop fastener 84 or other removably attachable means. The other end of the hook-and-loop fastener is connected to the corresponding resistance band 88 that runs along the side of the arm opposite to the dorsal arm-resistance band 74.

As shown in FIG. 6, the first finger slot may engage the ring finger while the second finger slot 78 may engage the middle finger when such fingers are placed through the slots. The free palmar, removably attachable end 82 of the hand stirrup 70 may then be brought into close proximity with the second half of the hook-and-loop fastener portion 86 of the palmar arm resistance band 88. By engaging the two halves of the hook-and-loop fastener 84, 86, the hand stirrup 70 is set in place so that flexion of the arms during aerobic activity or the like serves to exercise the long muscles of the arm. Adjustment of the hand stirrup 70 can be made by having an elongated second half of the hook-and-loop fastener portion 86 so that the first half of the hook-and-loop fastener 84 on the hand stirrup 70 can engage the second half of the hook-and-loop fastener portion anywhere along its length. By varying the tension on the dorsal and palmar arm resistance bands 74, 88, the resistance provided by the dorsal and palmar resistive bands 74, 88 may be altered and adjusted.

By moving the attachment of the resistance bands 74, 88 from the thumb via a thumb stirrup and to the hand via a hand stirrup, better distribution of the pressures generated by the resistive bands occurs. Additionally, those persons with thumb injuries are able to use a resistive exercise shirt along the lines of the previous application without further aggravating the injury or otherwise re-injuring the thumb. Other muscles in the hand are able to be exercised during the aerobic or other exercise session by use of the hand stirrup 70 that are not so exercised by a thumb stirrup. Additionally, greater control over the tension of the main resistive bands 74, 88 is provided by flexing of the wrist.

Figure 7:
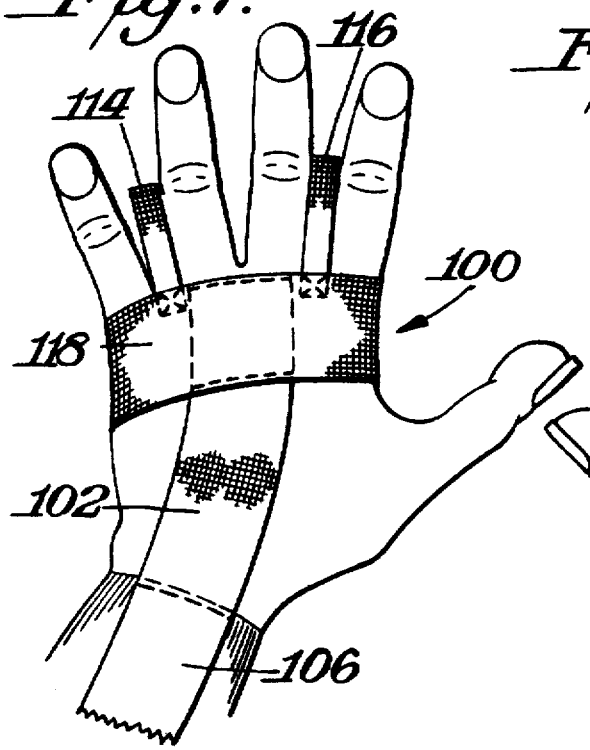
FIG. 7 is a dorsal plan view of an alternative embodiment of the hand stirrup of the present invention shown with the wearer's hand.
Figure 8:
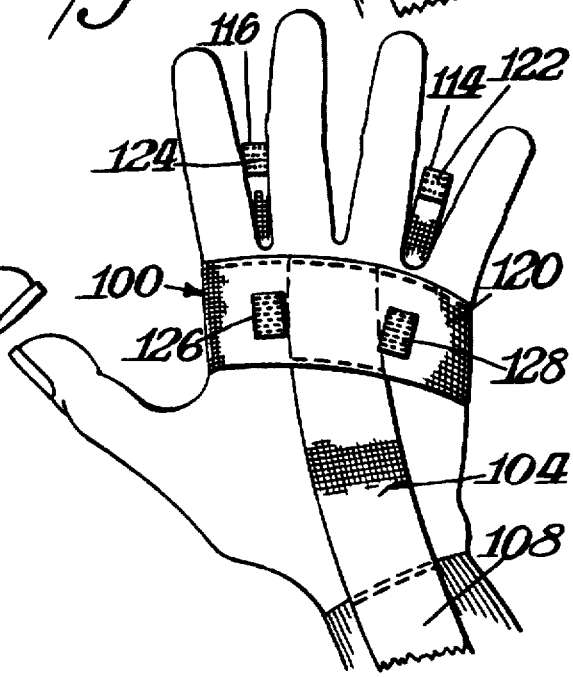
FIG. 8 is a palmar plan view of the hand stirrup of FIG. 7 shown with the wearer's hand.

As shown in FIGS. 7 and 8, an alternative embodiment of the hand stirrup of the present invention generally uses the span of the hand to engage the main resistance bands of the resistive exercise shirt.

In FIG. 7, the hand stirrup 100 encircles the palm of the hand between the thumb and fingers. Straps, or extensions, 102, 104, serve to connect the hand stirrup 100 to the opposing resistance arm bands 106, 108.

The hand stirrup 100 is generally an elastic circular band encircling the hand and may be made of elastic material similar to that of the resistive arm bands 106, 108. The straps, or extensions, 102, 104 attach generally central to the dorsal and palmar sides of the hand stirrup 100. The hand stirrup 100 may be sized to snugly engage the hand about which it is wrapped in proportion to the size of the wearer and the wearer's hands. With use of materials that are sufficiently elastic, the hand stirrup 100 may be constructed so that one size fits all.

In order to provide greater support and stability for the hand stirrup 100, elastic finger bands 114, 116 serve to removably attach the dorsal side of the hand stirrup 118 to the palmar side of the hand stirrup 120. Any number of removably attachable means may be used in order to provide removable attachments between the elastic finger bands 114, 116 and the hand stirrup 100. As shown in FIG. 8, mating portions of hook-and-loop fasteners are used on the elastic finger bands 114, 116 and the palmar side of the hand stirrup 120. One half of a hook-and-loop fastener is attached to the underside of the elastic finger bands 122, 124.

The mating portions of the hook-and-loop fasteners face outwardly from the palmar side 120 of hand stirrup 100 to engage the first half of the hook-and-loop fasteners on the elastic finger bands 114, 116. Corresponding hook-and-loop portion 126 corresponds to portion 124, and hook-and-loop portion 128 corresponds to portion 122. As indicated by FIG. 8, the corresponding hook-and-loop fastener portions 126, 128 are generally rectangular in configuration with the long axis running along the length of the hand. The hook-and-loop fastening portions upon the elastic finger bands 114, 116 are generally square in shape, having the same width as the corresponding portions 126, 128.

This allows some adjustment as to the tension provided by the elastic finger bands in supporting the hand stirrup 100 against the tension applied by the arm bands 106, 108. By providing such elastic finger bands 114, 116, the hand stirrup 100 is better stabilized and supported upon the hand. With the elastic finger bands, the elastic circular band of the hand stirrup 100 is more easily retained upon the hand and allows the tension applied by the main resistive bands 106, 108 to be distributed all the way to the end of the hand. As the elastic finger bands fit between the first and last pairs of fingers, any tension applied upon the hand stirrup 100 by the resistive panels 106, 108 is well distributed. In a further alternative embodiment, an additional elastic finger band (not shown) may attach to the hand stirrup 100 between the middle pair of fingers.

Figure 9:
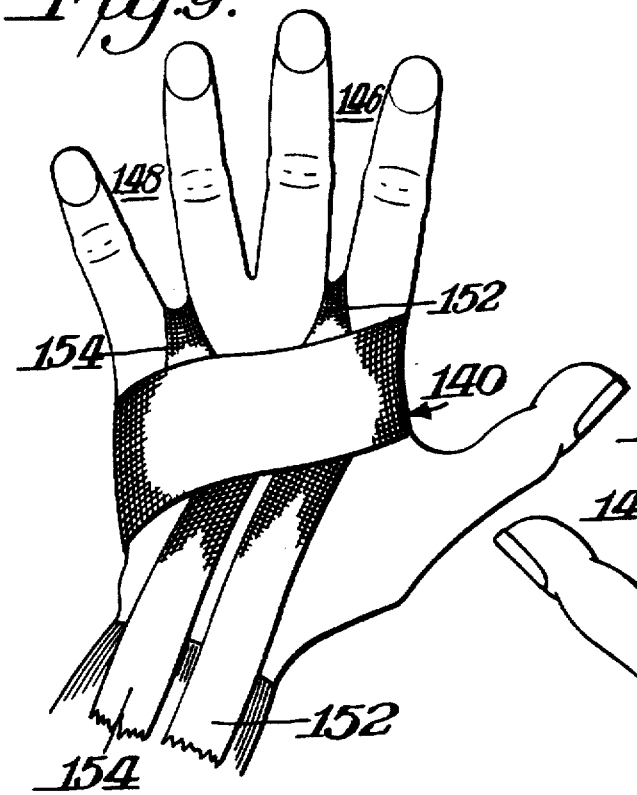
FIG. 9 is a dorsal plan view of another alternative embodiment of the hand stirrup of the present invention shown with the wearer's hand.
Figure 10:
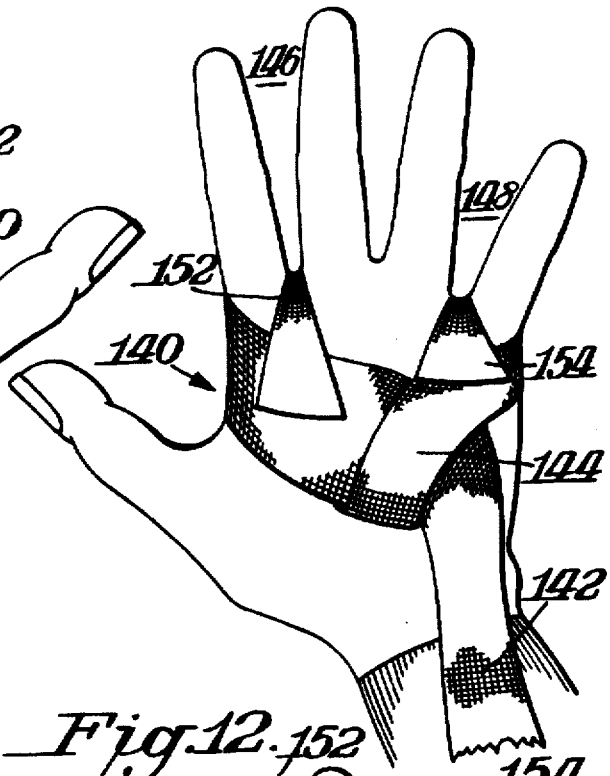
FIG. 10 is a palmar plan view of the hand stirrup of FIG. 9 shown with the wearer's hand.

Referring now to FIGS. 9 and 10, a second alternative embodiment of the hand stirrups of the present invention is shown in dorsal and palmar views, respectively. As shown in the dorsal view of FIG. 9, the hand stirrup 140 fits around the hand between the thumb and fingers to provide a secure attachment for the resistive bands of the resistive exercise shirt.

The hand stirrup 140 may be an extension of the palmar tension band 142 so that it is elastic, flexible, and able to adjustably fit to the hand. Alternatively, materials such as CORDURA® nylon, or the like may be used to provide a less elastic but flexible hand stirrup 140.

At the end of the palmar tension band 142 forming the hand stirrup 140 is a slip loop of material 144 through which the palmar tension band 142 may slidably travel. The loop 144 may be constructed by doubling back a length of palmar tension band 142 material and affixing the free end thereof to the palmar tension band 142. A loop is then defined which, when secured around the palmar tension band 142, forms the hand stirrup 140.

In order to secure the dorsal resistive band to the hand stirrup 140 (and thereby maintain tension upon the whole sleeve of the resistive exercise shirt), attachment to the hand stirrup 140 is effected by extensions passing through the interstices 146, 148 of the first and last pairs of fingers, respectively. The extensions 152, 154 from the dorsal tension band can be achieved in a number of ways, two of which may be easily accomplished.

As shown in FIG. 9, two bands extend up the wrist toward the finger interstices 146, 148. These tension bands may be part of a dual pair of tension bands that traverse the dorsal side of the sleeve, creating the desired tension for the exercise-resistive shirt in conjunction with palmar tension band 142. Alternatively, the extensions 152, 154 may be two separate extensions that split from a single tension band (not shown) that extends along the dorsal, or upper, side of the sleeve. Adjacent the wrist or elsewhere, the single tension band may split into two forks for the extensions 152, 154.

As shown in FIG. 10, the dorsal tension-band extensions 152, 154 pass through the interstices between the first and last pairs of fingers 146, 148 so that they may engage the hand stirrup 140. At the ends of the tension-band extensions 152, 154, snaps, buttons, hook-and-loop fastener material, or the like may be used to provide removably attachable means by which the tension-band extensions 152, 154 may be attached to the hand stirrup 140. Such removable attachment means should be attachable in nature so that the tension along the sleeve having the hand stirrup 140 may be adjusted according to the wearer's preference.

Figure 11:
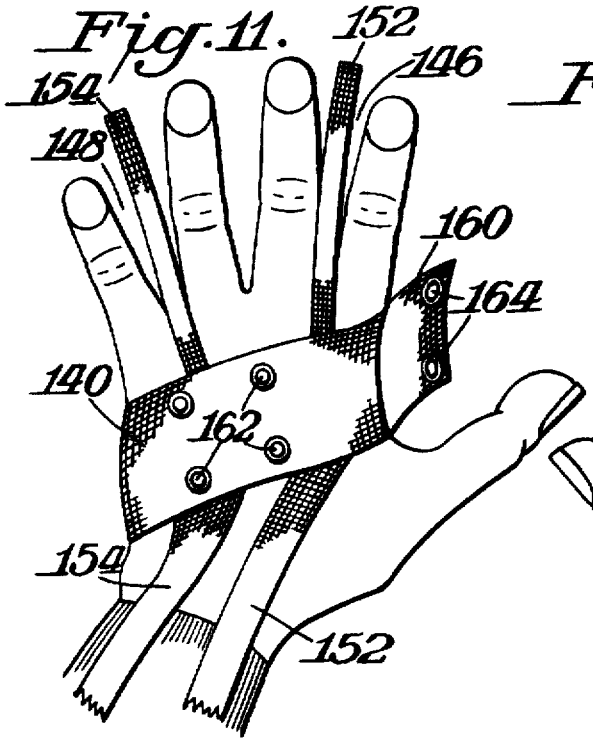
FIG. 11 is a dorsal plan view of another embodiment of the hand stirrup of the present invention shown with the wearer's hand.
Figure 12:
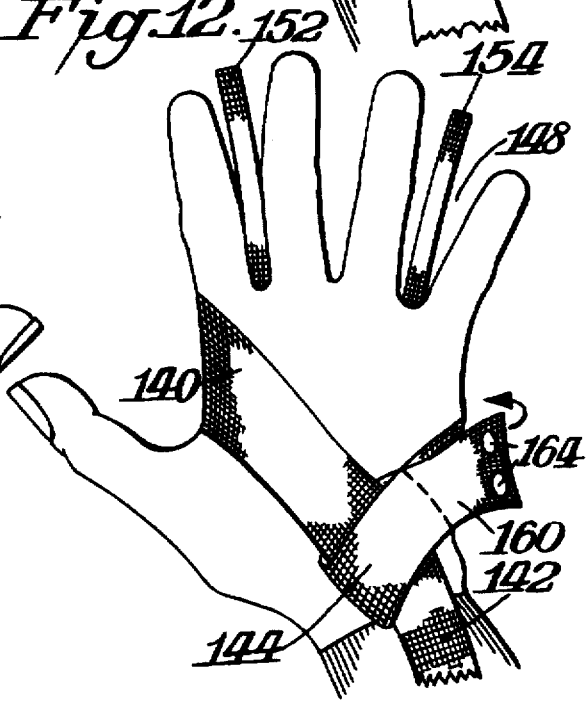
FIG. 12 is a palmar plan view of the hand stirrup of FIG. 11 shown with the wearer's hand.

Referring now to FIGS. 11 and 12, the slip-loop arrangement, as shown in FIG. 10, may be modified to include an adjustment flap 160 which attaches by removable attachment means such as snaps or the like to the back of the hand stirrup 140.

As shown in FIGS. 11 and 12, snaps or other removable attachment means 162 are present on the back of the hand stirrup 140. As shown in FIG. 11, a plurality of pairs of snaps 162 may be present in order to provide a measure of adjustability to the hand stirrup 140. The adjustment flap 160 may have a single set of snaps 164 that can selectably engage the dorsal snaps 162. As for the embodiment shown in FIGS. 9 and 10, the dorsal tension-band extensions 152, 154 may pass through the finger and interstices 146, 148 to attachably but removably engage the hand stirrup 140 to secure the hand stirrup 140 to the hand, to distribute tension from the main tension bands across the hand, and to provide a more secure fit for the hand stirrup.

The hand stirrup 140 of FIGS. 9 through 12 requires that the main tension-band extensions 152, 154 be placed between the dorsal side of the hand and the hand stirrup 140. The hand may then be passed through the open loop defined by the hand stirrup 140 with the palmar tension band 152 pulled upon to tighten the hand stirrup 140 about the hand and to secure the tension-band extensions 152, 154 underneath the hand stirrup 140. Upon so tensioning the hand stirrup 140 about the hand, the dorsal tension-band extensions 152, 154 are passed through the interstices 146, 148 of the first and last finger pairs and brought about to removably attach to the palmar side of the hand stirrup 140. Upon securing the dorsal tension-band extensions 152, 154 to the palmar side of the hand stirrup 140, the hand stirrup 140 is now in place and aerobic exercise may now take place with muscular development of the muscles of the arms simultaneously occurring.

If, as in FIGS. 11 and 12, an adjustment flap 160 is present, the adjustment flap 160 may be affixed to the dorsal side of the hand stirrup 140 in order to securely engage the hand stirrup 140 to the hand. After sufficiently adjusting the adjustment flap 160, the dorsal tension-band extension 152, 154 may be secured to the palmar side of the hand stirrup 140; and the engagement of aerobic activities with concurrent muscular development of the arms may take place by a resistance of the tension bands against the muscles of the arms during muscular movement.

While the present invention has been described with regards to particular embodiments, it is recognized that additional variations of the present invention may be devised without departing from the inventive concept.

What I claim is:

1. A pair of resistive exercise pants, comprising:

a pants portion having first and second pant legs and defining openings for a pair of feet and a hip or waist;

first and second suspenders coupled to said pants portion near said opening for said waist;

first resistive means for resisting motion and exercising muscles, said first resistive means incorporated into said pants portion and traversing the length of said first pant leg, said first resistive means aligned with long muscles of a first leg inserted into said first pant leg and elastically resisting motions made by said first leg so that said first resistive means exercises said first leg, said first pant leg otherwise free of other resistive means to optimize said first pant leg by reducing weight, enhancing breathability, and to focus resistance upon said long muscles of said first leg;

a first stirrup coupled to said first resistive means;

second resistive means for resisting motion and exercising muscles, said second resistive means incorporated into said pants portion and traversing the length of said second pant leg, said second resistive means aligned with long muscles of a second leg inserted into said second pant leg and elastically resisting motions made by said second leg so that said second resistive means exercises said second leg, said second pant leg otherwise free of other resistive means to optimize said second pant leg by reducing weight, enhancing breathability, and to focus resistance upon said long muscles of said second leg; and a second stirrup coupled to said second resistive means; whereby a person seeking exercise may don the resistive exercise pants and tension the resistive exercise pants between said suspenders and said first and second stirrups so as to resist movement of said person's legs, thereby augmenting muscular effort and exercise when said person moves said legs.

2. The pair of resistive exercise pants of claim 1, wherein said first resistive means comprises:

a first pair of resistive bands traversing the length of said first pant leg along a front side thereof; and a second pair of resistive bands traversing the length of said first pant leg along a rear side thereof, said second pair of resistive bands oppositely opposed said first pair of resistive bands;

said first and second pair of resistive bands merging near a heel portion of said first pant leg to form said first stirrup.

3. The pair of resistive exercise pants of claim 2, wherein said first pair of resistive bands are generally parallel.

4. The pair of resistive exercise pants of claim 3, wherein said first pair of resistive bands bifurcate approximately adjacent a knee portion of said first pant leg and thereafter conformedly curve about a calf portion of said first pant leg.

5. The pair of resistive exercise pants of claim 1, wherein said first resistive means comprises:

a first single integral resistive band traversing the length of said first pant leg along a front side thereof; and a second single integral resistive band traversing the length of said first pant leg along a rear side thereof, said second single integral resistive band oppositely opposed said first single integral resistive band;

said first and second single integral resistive bands merging near a heel portion of said first pant leg to form said first stirrup.

6. The pair of resistive exercise pants of claim 5, wherein said first single integral resistive band bifurcates approximately adjacent a knee portion of said first pant leg and thereafter merges with said second single integral resistive band to form said first stirrup.

7. The pair of resistive exercise pants of claim 6, wherein said second single integral resistive band bifurcates approximately adjacent a knee portion of said first pant leg and thereafter merges with said first single integral resistive band to form said first stirrup.

8. The pair of resistive exercise pants of claim 1, further comprising:

said first and second suspenders being adjustable; and said first and second stirrups being adjustable.

9. A pair of resistive exercise pants, comprising:

a pants portion having first and second pant legs and defining openings for a pair of feet and a hip or waist;

first and second adjustable suspenders coupled to said pants portion near said opening for said waist;

first resistive means for resisting motion and exercising muscles, said first resistive means incorporated into said pants portion and traversing the length of said first pant leg, said first resistive means aligned with long muscles of a first leg inserted into said first pant leg and elastically resisting motions made by said first leg so that said first resistive means exercises said first leg, said first pant leg otherwise free of other resistive means to optimize said first pant leg by reducing weight, enhancing breathability, and to focus resistance upon said long muscles of said first leg, said first resistive means including a first pair of resistive bands traversing the length of said first pant leg along a front side thereof and a second pair of resistive bands traversing the length of said first pant leg along a rear side thereof, said second pair of resistive bands oppositely opposed said first pair of resistive bands and said first pair of resistive bands being bifurcated approximately adjacent a knee portion of said first pant leg and thereafter conformedly curving about a calf portion of said first pant leg;

said first and second pair of resistive bands merging near a heel portion of said first pant leg to form a first adjustable stirrup coupled to said first resistive means; and second resistive means for resisting motion and exercising muscles, said second resistive means incorporated into said pants portion and traversing the length of said second pant leg, said second resistive means aligned with long muscles of a second leg inserted into said second pant leg and elastically resisting motions made by said second leg so that said second resistive means exercises said second leg, said second pant leg otherwise free of other resistive means to optimize said second pant leg by reducing weight, enhancing breathability, and to focus resistance upon said long muscles of said second leg, said second resistive means including a third pair of resistive bands traversing the length of said second pant leg along a from side thereof and a fourth pair of resistive bands traversing the length of said second pant leg along a rear side thereof, said fourth pair of resistive bands oppositely opposed said third pair of resistive bands and said third pair of resistive bands being bifurcated approximately adjacent a knee portion of said second pant leg and thereafter conformedly curving about a calf portion of said second pant leg;

said third and fourth pair of resistive bands merging near a heel portion of said second pant leg to form a second adjustable stirrup coupled to said second resistive means; whereby a person seeking exercise may don the resistive exercise pants and tension the resistive exercise pants between said suspenders and said stirrups so as to resist movement of said person's legs, thereby augmenting muscular effort and exercise when said person moves said legs.

10. A hand stirrup for a resistive exercise shirt having resistive bands along a sleeve thereof, the hand stirrup comprising:

a first dorsal end attachable to a first resistive band of the resistive exercise shirt;

a second palmar end attachable to a second resistive band of the resistive exercise shirt, said second resistive band generally oppositely opposed said first resistive band; and a plurality of straps defining at least one slot through which a finger is inserted, said plurality of straps interconnecting said first dorsal end and said second palmar end;

said first dorsal end attaching to said first resistive band on a dorsal side of a hand, said straps interlacing with fingers on said hand by passing through interstices of said fingers, said second palmar end attaching to said second resistive band on a palmar side of said hand; whereby said resistive bands and said sleeve of said resistive exercise shirt may be secured to said hand by the hand stirrup to provide resistance and exercise to muscles of an arm associated with said hand.

11. The hand stirrup for a resistive exercise shirt of claim 10, further comprising:

said first dorsal end being permanently attached to said first resistive band; and said second palmar end being removably and adjustably attachable to said second resistive band.

12. The hand stirrup of claim 11, further comprising:

said plurality of straps defining two slots through which middle and ring fingers of said hand may pass.

13. The hand stirrup of claim 12, wherein said plurality of straps is elastic.

14. The hand stirrup of claim 13, wherein said second palmar end is removably and adjustably attachable to said second resistive band by removably attachable means selected from the group consisting of hook and loop fasteners, snaps, and buttons.

15. A hand stirrup for an resistive exercise shirt having resistive bands along a sleeve thereof, the hand stirrup comprising:

a first dorsal end permanently attached to a first resistive band of the resistive exercise shirt;

a second palmar end removably and adjustably attachable to a second resistive band of the resistive exercise shirt by removably and adjustably attachable means selected from the group consisting of hook and loop fasteners, snaps, and buttons, said second resistive band generally oppositely opposed said first resistive band; and a plurality of elastic straps defining at least two slots through which middle and ring fingers of a hand may be respectively inserted, said plurality of straps interconnecting said first dorsal end and said second palmar end;

said first dorsal end attaching to said first resistive band on a dorsal side of said hand, said straps interlacing with said fingers on said hand by passing through interstices of said fingers, said second palmar end removably and adjustably attaching to said second resistive band on a palmar side of said hand; whereby said resistive bands and said sleeve of said resistive exercise shirt may be secured to said hand by the hand stirrup to provide resistance and exercise to muscles of an arm associated with said hand.

16. A hand stirrup for a resistive exercise shirt having resistive bands along a sleeve thereof, the hand stirrup comprising:

an elastic band snugly encircling a hand adjacent fingers of said hand and above a thumb of said hand;

said elastic band attached on a dorsal side of said hand to a first resistive band of the resistive exercise shirt, said elastic band attached on a palmar side of said hand to a second resistive band of the resistive exercise shirt, said second resistive band generally oppositely opposed said first resistive band; and an elastic interstitial finger band attached at a first dorsal end to a dorsal side of said elastic band, said elastic interstitial finger band attached at a second palmar end to a palmar side of said elastic band, said elastic interstitial finger band passing through an interstice between fingers of said hand; whereby said resistive bands and said sleeve of said resistive exercise shirt may be secured to said hand by the hand stirrup to provide resistance and exercise to muscles of an arm associated with said hand.

17. A hand stirrup for a resistive exercise shirt having resistive bands along a sleeve thereof, the hand stirrup comprising:

an elastic band snugly encircling a hand adjacent fingers of said hand and above a thumb of said hand, said elastic band formed from a loop of material extending from a first resistive band of the resistive exercise shirt;

an elastic interstitial finger band coupled to a second resistive band of the resistive exercise shirt and passing through an interstice between fingers of said hand, said second resistive band generally oppositely opposed said first resistive band, said elastic interstitial finger band removably and adjustably attaching to said elastic band on a side of said hand the same as said first resistive band at removable and adjustable finger band attachment means, said removable and adjustable finger band attachment means selected from the group consisting of hook and loop fasteners, snaps, and buttons, said elastic interstitial finger band passing between said hand and said elastic band; whereby said resistive bands and said sleeve of said resistive exercise shirt may be secured to said hand by the hand stirrup to provide resistance and exercise to muscles of an arm associated with said hand.

18. The hand stirrup for a resistive exercise shirt of claim 17, wherein said elastic band further comprises:

adjustment means for adjusting said elastic band, said adjustment means tightening or loosening said loop forming said elastic band.

19. The hand stirrup of claim 18, wherein said adjustment means comprises:

a flap of material extending from adjacent an end of said loop of material; and removably attachable means for removably attaching said flap to said elastic band, a first half of said removably attachable means associated with said flap and a second half of said removably attachable means associated with said elastic band.

20. The hand stirrup of claim 19, wherein said removably attachable means is selected from the group consisting of hook and loop fasteners, snaps, and buttons.

21. A pair of resistive exercise pants, comprising: a pants portion having first and second pant legs and defining openings for a pair of feet and a hip or waist; first and second suspenders coupled to said pants portion near said opening for said waist; first resistive means for resisting motion and exercising muscles, said first resistive means incorporated into said pants portion and traversing the length of said first pant leg, said first resistive means aligned with long muscles of a first leg inserted into said first pant leg and elastically resisting motions made by said first leg so that said first resistive means exercises said first leg, said first pant leg otherwise free of other resistive means to optimize said first pant leg by reducing weight, enhancing breathability, and to focus resistance upon said long muscles of said first leg; a first foot anchor structure coupled to said first resistive means; second resistive means for resisting motion and exercising muscles, said second resistive means incorporated into said pants portion and traversing the length of said second pant leg, said second resistive means aligned with long muscles of a second leg inserted into said second pant leg and elastically resisting motions made by said second leg so that said second resistive means exercise said second leg, said second pant leg otherwise free of other resistive means to optimize said second pant leg by reducing weight, enhancing breathability, and to focus resistance upon said long muscles of said second leg; and a second foot anchor structure coupled to said second resistive means; whereby a person seeking exercise may don the resistive exercise pants and tension the resistive exercise pants between said suspenders and said first and second stirrups so as to resist movement of said person's legs, thereby augmenting muscular effort and exercise when said person moves said legs.

22. The pair of resistive exercise pants of claim 21, wherein said first pair of resistive bands are generally parallel above a knee portion.

23. The pair of resistive exercise pants of claim 22, wherein said first pair of resistive bands bifurcate approximately adjacent the knee portion of said first pant leg and thereafter conformedly curve about a calf portion of said first pant leg.

24. The pair of resistive exercise pants of claim 21, wherein said first resistive means comprises: a first single integral resistive band traversing the length of said first pant leg along a front side thereof; and a second single integral resistive band traversing the length of said first pant leg along a rear side thereof, said second single integral resistive band oppositely opposed said first single integral resistive band; said first and second single integral resistive bands merging near a heel portion of said first pant leg to form said foot anchor structure.

25. The pair of resistive exercise pants of claim 24, wherein said first single integral resistive band bifurcates approximately adjacent a knee portion of said first pant leg and thereafter merges with said second single integral resistive band to form said first foot anchor structure.

26. The pair of resistive exercise pants of claim 25, wherein said second single integral resistive band bifurcates approximately adjacent a knee portion of said first pant leg and thereafter merges with said first single integral resistive band to form said first foot anchor structure.

27. The pair of resistive exercise pants of claim 21, further comprising: the first and second suspenders being adjustable; and said first and second foot anchor structure being adjustable.

28. A pair of resistive exercise pants, comprising: a pants portion having first and second pant legs and defining openings for a pair of feet and a hip or waist; first and second suspenders coupled to said pants portion near said opening for said waist; first resistive means for resisting motion and exercising muscles, said first resistive means incorporated into said pants portion and traversing the length of said first pant leg, said first resistive means aligned with long muscles of a first leg inserted into said first pant leg and elastically resisting motions made by said first leg so that said first resistive means exercises said first leg, said first resistive means including a first pair of resistive bands traversing the length of said first pant leg along a front side thereof and a second pair of resistive bands traversing the length of said first pant leg along a rear side thereof, said second pair of resistive bands oppositely opposed said first pair of resistive bands and said first pair of resistive bands being bifurcated approximately adjacent the knee portion of said first pant leg and thereafter conformedly curving about a calf portion of said first pant leg; said first and second pair of resistive bands merging near a heel portion of said first pant leg to form a first adjustable stirrup coupled to said first resistive means; and second resistive means for resisting motion and exercising muscles, said second resistive mans incorporated into said pants portion and traversing the length of said second pant leg, said second resistive means aligned with long muscles of a second leg inserted into said second pant leg and elastically resisting motions made by said second leg so that said second resistive means exercises said second leg, said second resistive means including a third pair of resistive bands traversing the length of said second pant leg along a front side thereof and a fourth pair of resistive bands traversing the length of said second pant leg along a rear side thereof, said fourth pair or resistive bands oppositely opposed said third pair of resistive bands and said third pair of resistive bands being bifurcated approximately adjacent the knee portion of said second pant leg and thereafter conformedly curving about a calf portion of said second pant leg; said third and fourth pair of resistive bands merging near a heel portion of said second pant leg to form a second adjustable stirrup coupled to said second resistive means; whereby a person seeking exercise may don the resistive exercise pants and tension the resistive exercise pants between said suspenders and said stirrups so as to resist movement of said person's legs, thereby augmenting muscular effort and exercise when said person moves said legs.

29. The pair of resistive exercise pants of claim 28, wherein each of said first pair and said third pair of resistive bands are generally parallel above the knee portion.

30. A hand stirrup for an resistive exercise shirt having resistive bands along a sleeve thereof, the hand stirrup comprising: a first dorsal end attached to a first resistive band of the resistive exercise shirt; a second palmar end attached to a second resistive band of the resistive exercise shirt, said second resistive band generally oppositely opposed said first resistive band; and a plurality of elastic straps defining at least one slot through which at least one finger of a hand may be inserted, said plurality of straps interconnecting said first dorsal end and said second palmar end; said first dorsal end attaching to said first resistive band on a dorsal side of said hand, said straps interlacing with said fingers on said hand by passing through interstices Of said fingers, said second palmar end attaching to said second resistive band on a palmar side of said hand; whereby said resistive bands and said sleeve of said resistive exercise shirt may be secured to said hand by the hand stirrup to provide resistance and exercise to muscles of an arm associated with said hand.

31. The hand stirrup for a resistive exercise shirt of claim 30, further comprising: said first dorsal end being permanently attached to said first resistive band; and said second palmar end being removably and adjustably attachable to said second resistive band.

32. The hand stirrup of claim 30, further comprising: said plurality of straps defining two slots through which middle and ring fingers of said hand may pass.

33. The hand stirrup of claim 32, wherein one of said first dorsal end and said second palmar end is removably and adjustably attachable to its resistive band.

34. The hand stirrup of claim 33, wherein said end is removably attachable by structure means selected from the group consisting of hook and loop fasteners, snaps, and buttons.

35. A hand stirrup for a resistive exercise shirt having resistive bands along a sleeve thereof, the hand stirrup comprising: an elastic band for snugly encircling a hand adjacent fingers of said hand and above a thumb of said hand, said elastic band formed from a loop of material extending from a first resistive band of the resistive exercise shirt; an elastic interstitial finger band coupled to a second resistibe band of the resistive exercise shirt and passing through an interstice between fingers of said hand, said second resistive band generally oppositely opposed said first resistibe band, said elastic interstitial finger band removably and adjustably attaching to said elastic band on a side of said hand the same as said first resistibe band at removable and adjustable finger band attachment structure, said elastic interstitial finger band passing between said hand and said elastic band; whereby said resistibe bands and said sleeve of said resistibe exercise shirt may be secured to said hand by the and stirrup to provide resistance and exercise to muscles of an arm associated with said hand.

36. The hand stirrup for a resistive exercise shirt of claim 35, wherein said elastic band further comprises: adjustment means for adjusting said elastic and, said adjustment means tightening or loosening said loop forming said elastic and.

37. The hand stirrup of claim 35, wherein said adjustment means comprises: a flap of material extending from adjacent an end of said loop of material; and removably attachable structure for removably attaching said flap to said elastic and, a first half of said removably attachable structure associate with said flap and a second half of said removably attachable structure associated with said elastic band.

38. A resistive exercise garment including a pants portion and a shirt portion, said pants portion having first and second pants legs and defining openings for a pair of feet and a hip or waist; said portion having first and second arms and defining openings for the hands; said shirt portion having an anterior and a posterior; a first set of resistive elements extending across said anterior of said shirt from said first to said second arms; a second set of resistive elements extending across said posterior of said shirt from said first to said second arms; an abdominal resistive panel generally centrally located on said anterior of said shirt and extending downwardly from said first set of resistive elements to said pants portion; and a rector spinal resistive panel generally centrally located on said posterior of said shirt and extending downwardly from said second set of resistive elements to said pants portion.

* * * * *